US005622513A

United States Patent [19]

Kuang

[11] Patent Number: 5,622,513

[45] Date of Patent: Apr. 22, 1997

[54] LAMP SOCKET

[76] Inventor: Yuan-Peng Kuang, No. 78, Tung-Nan St., Hsin Chu City, Taiwan

[21] Appl. No.: 547,361

[22] Filed: Oct. 24, 1995

[51] Int. Cl.[6] ..... H01R 4/50

[52] U.S. Cl. ..... 439/340; 439/419

[58] Field of Search ..... 439/419, 340, 439/414, 659, 611–619, 596, 660, 696

[56] References Cited

U.S. PATENT DOCUMENTS

| | | | |
|---|---|---|---|
| 5,385,485 | 1/1995 | Fu | 439/419 |
| 5,439,389 | 8/1995 | Cheng et al. | 439/419 |
| 5,474,467 | 12/1995 | Chen | 439/419 |
| 5,511,989 | 4/1996 | Cheng et al. | 439/419 |
| 5,518,425 | 5/1996 | Tsai | 439/419 |

*Primary Examiner*—Hien Vu
*Attorney, Agent, or Firm*—Bo-In Lin

[57] ABSTRACT

A lamp socket including a socket body consisting of a left half and a right half, wherein the right half has a base and a right half circularly arched upright wall raised from the base, the base having a rectangular slot and retaining hole in communication with the rectangular slot; the left half has a left half circularly arched upright wall supported on the base and abutted to the right half circularly arched upright wall of the right half, a locating ring at the top hooked on the right half circularly arched upright wall of the right half, a locating rod at the bottom inserted into the rectangular slot of the base, and a hook extended from the locating rod and hooked in the retaining hole of the base.

3 Claims, 5 Drawing Sheets

LAMP SOCKET

BACKGROUND OF THE INVENTION

The present invention relates to lamp sockets, and relates more particularly to such a lamp socket which has a socket body consisting of a left half and a right half connected together by hooking the locating ring of the left half on the upright wall of the right half and fastening the hook of the left half to the retaining hole of the right half.

A regular lamp socket, as shown in FIG. 1, is generally comprised of a socket body 10' having a spiral thread 11' for mounting the base of a lamp bulb, and two metal contact plates, namely, the center metal contact plate and the side metal contact plate respectively fastened to the socket body 10' for connection to a respective conductor of the electric wire. The side metal contact plate 20' has raised portions 21' for contact with the ring contact of the lamp bulb. Because the socket body 10' is integrally molded from plastics, the depth of the spiral groove 11' is limited to a certain range. If the spiral groove 11' is designed deeper, the stripping of the mold will become more difficult. Another drawback of this structure of lamp socket is that a contact error between the raised portions 21' of the side metal contact plate 20' and the ring contact of the lamp bulb tends to occur when the lamp bulb is touched by an external object.

FIGS. 2 and 3 show another structure of lamp socket according to the prior art, in which the socket body 10' is comprised of two symmetrical halves connected together by fitting respective pins 12' into respective pin holes 13' and then mounting a hoop 30' around the two symmetrical halves; the side metal contact plate 20' has a projecting contact strip 22' formed by stamping for contact with the ring contact of the lamp bulb. This structure of lamp socket is complicated to assemble. Furthermore, the projecting contact strip 22' of the side metal contact plate 20' tends to be broken after a long use.

SUMMARY OF THE INVENTION

The present invention has been accomplished to provide a lamp socket which eliminates the aforesaid drawbacks. According to one aspect of the present invention, the lamp socket comprises a socket body consisting of a left half and a right half, wherein the right half has a base and a circularly arched upright wall raised from the base, the base having a rectangular slot and retaining hole in communication with the rectangular slot; the left half has a circularly arched upright wall supported on the base and abutted to the circularly arched upright wall of the right half, a locating ring at the top hooked on the circularly arched upright wall of the right half, a locating rod at the bottom inserted into the rectangular slot of the base, and a hook extended from the locating rod and hooked in the retaining hole of the base.

According to another aspect of the present invention, the side metal contact plate comprises a longitudinal reinforcing rib formed by stamping for contact with the base of the lamp bulb, and a locating flange for positioning in a locating slot on the base of the right half of the socket body.

DETAILED DESCRIPTION OF THE PREFERRED EMBODIMENT

Figure 1:
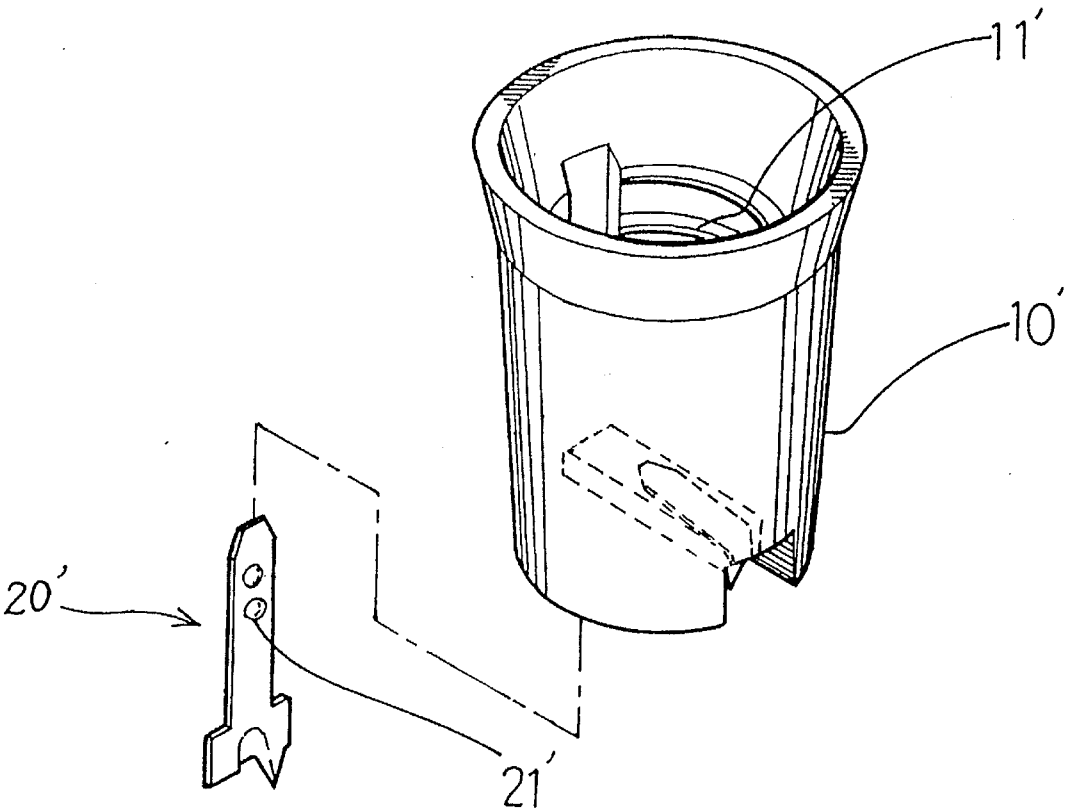
FIG. 1 (PRIOR ART)
FIG. 1 shows a lamp socket according to the prior art.
Figure 2:
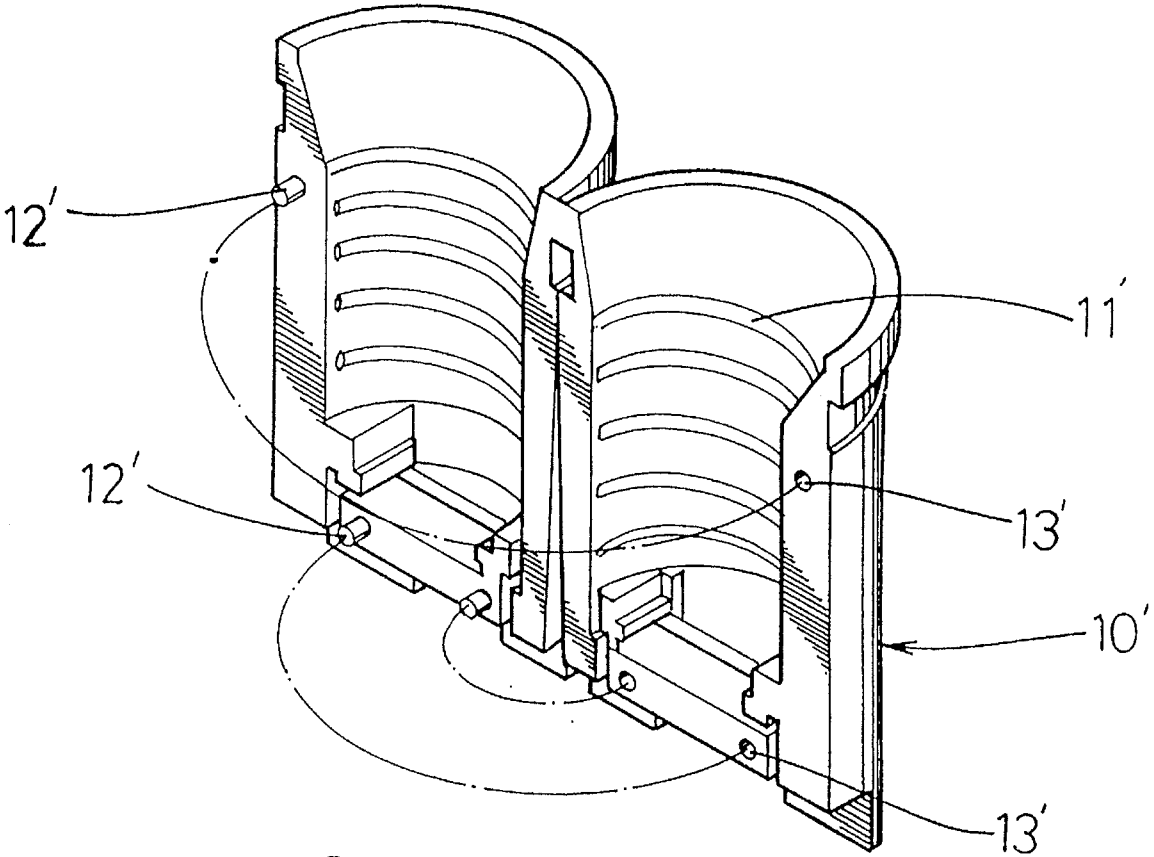
FIG.2 (PRIOR ART)
FIG. 2 shows another structure of lamp socket according to the prior art.
Figure 3:
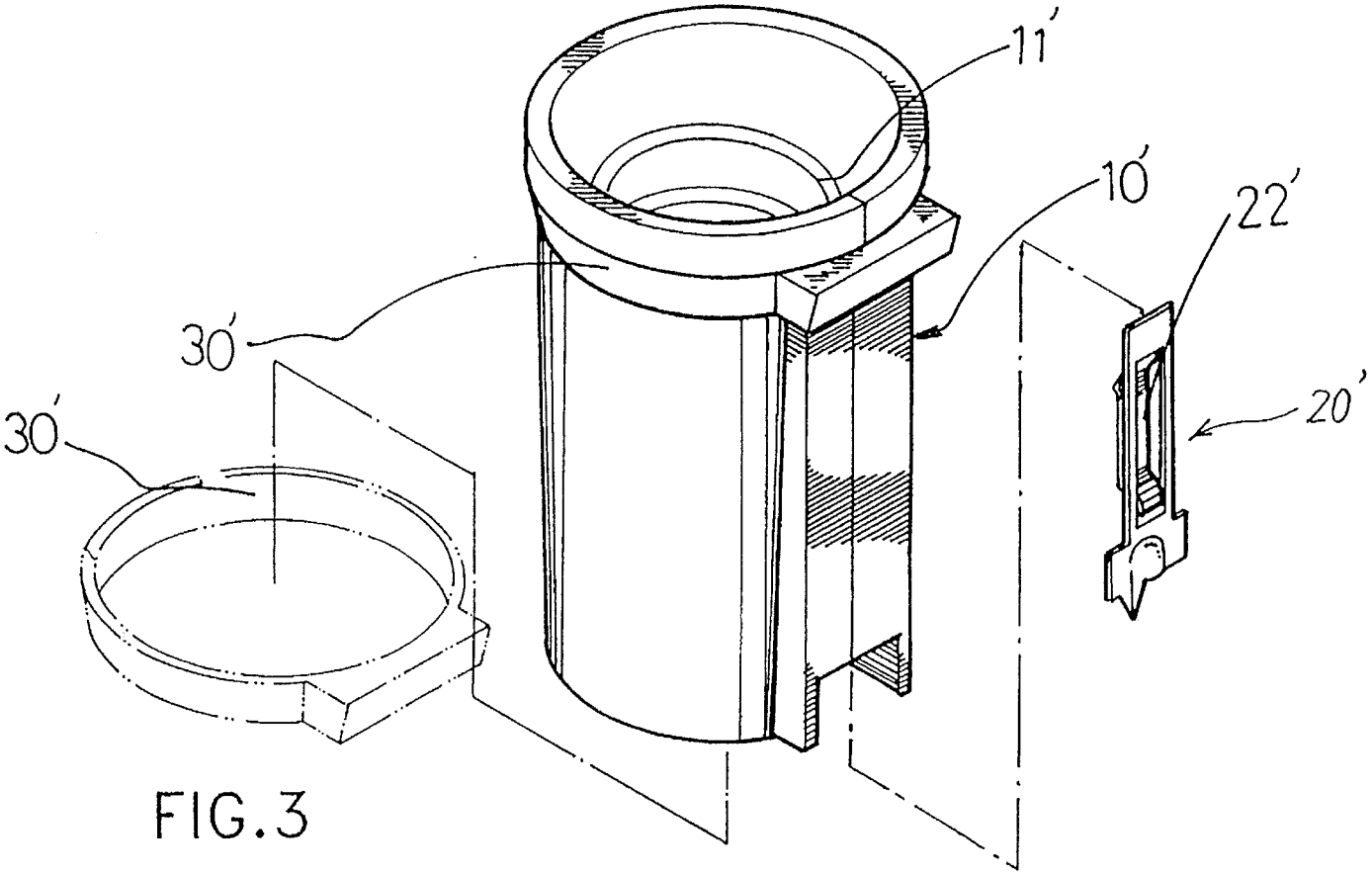
FIG. 3 (PRIOR ART)
FIG. 3 shows the lamp socket of FIG. 2 assembled.
Figure 4:
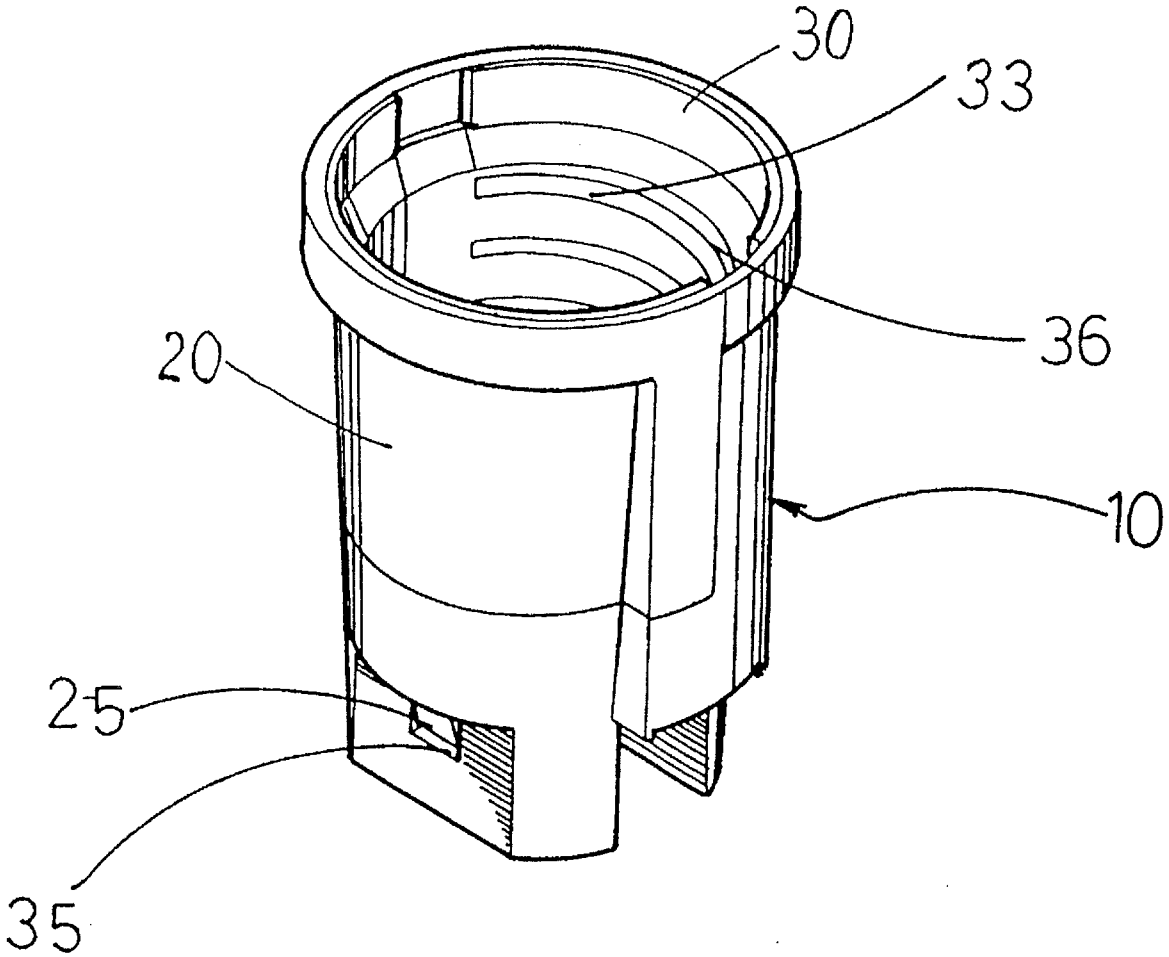
FIG. 4 is an elevational view of a lamp socket according to the present invention.

Referring to FIG. 4, a lamp socket in accordance with the present invention is generally comprised of a socket body 10 consisting of a left half 20 and a right half 30. Spiral grooves 23 and 33 are made on the inside of the left half 20 and the right half 30 so that the base of a lamp bulb can be threaded into the socket body 10. A longitudinal locating groove 36 is made on the right half 20 adjacent to the left half 20 for mounting a metal contact plate 40 (see also FIG. 5).

Figure 5:
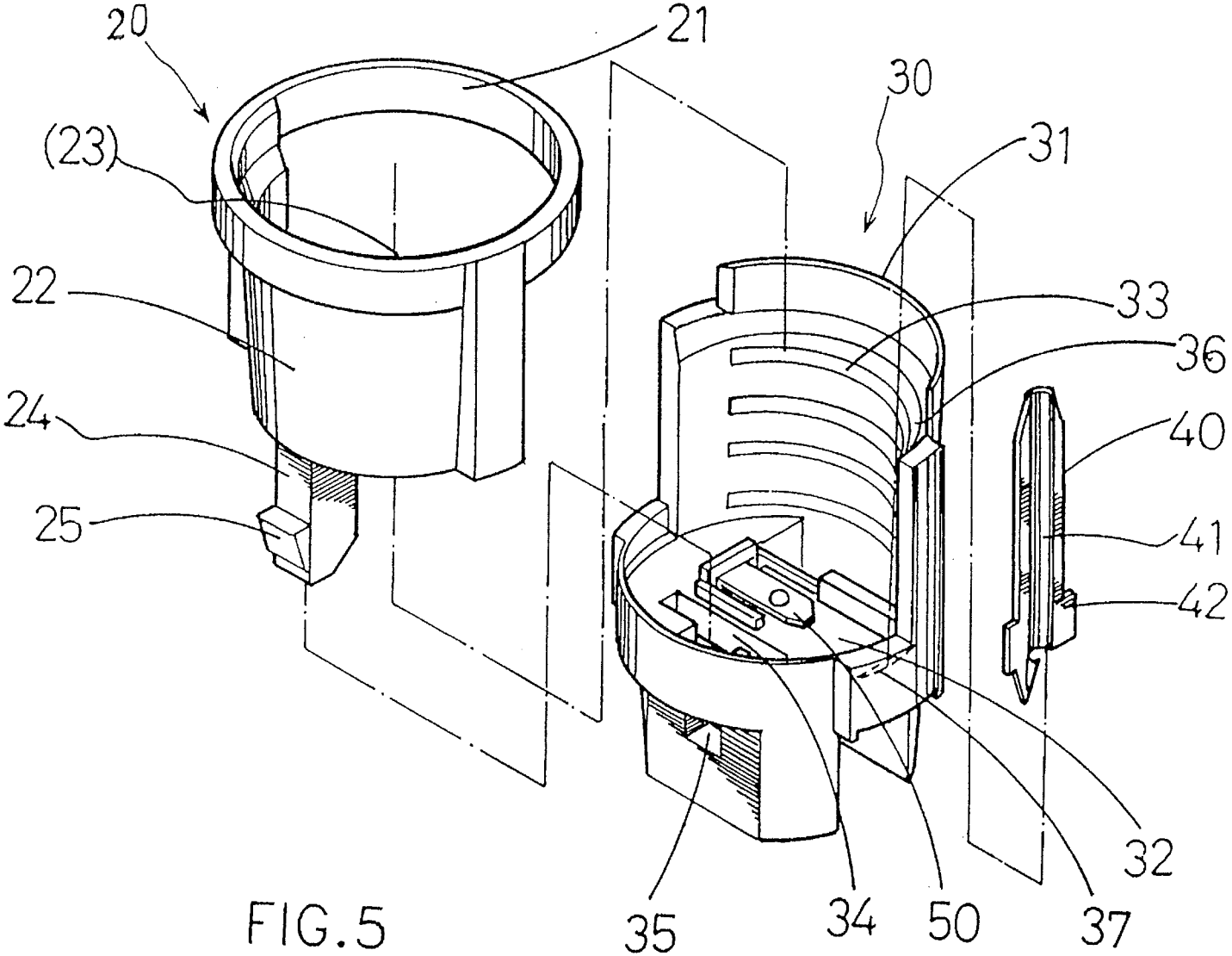
FIG. 5 is an exploded view of the lamp socket shown in FIG. 4.

Referring to FIG. 5 and FIG. 4 again, the left half 20 comprises a horizontal locating ring 21, a half circularly arched upright wall 22 extended downwardly from a part of the bottom edge of the horizontal locating ring 21, a plurality of spiral grooves 23 made on the half circularly arched upright wall 22 at an inner side at different elevations, a downward locating rod 24 extended downwardly from the bottom edge of the half circularly arched upright wall 22 and terminating in an outward hook 25; the right half 30 comprises a base 32, a half circularly arched upright wall 31 raised from the border of the base 32, a plurality of spiral grooves 33 made on the half circularly arched upright wall 31 at an inner side, a longitudinal locating groove 36 on the half circularly arched upright wall 31, a rectangular slot 34 on the base 32 at the top (the inner side of the base 32) remote from the half circularly arched upright wall 31, a retaining hole 35 at the bottom (outer side) of the base 32 in communication with the rectangular slot 34, and a side metal contact slot 37 disposed through the base 32 and aligned with the longitudinal locating groove 36. A center metal contact plate 50 is fixedly secured to the inner side of the base 32 with its pointed tip (not shown) extended outside the base 32 through a hole (not shown) thereof for connection to one conductor of the electric wire (the indexing of the directions described must be referred to FIG. 5), side metal contact plate 40 is fastened to the longitudinal locating groove 36 of the right half 30, having a longitudinal reinforcing rib 41, and a locating flange 42 stopped at the side metal contact slot 37. The longitudinal reinforcing rib 41 is formed on the side metal contact plate 40 by stamping for contact with the base of the lamp bulb. When the side metal contact plate 40 is installed, its pointed bottom end extends to the outside of the base 32 through the side metal contact slot 37 for connection to another conductor of the electric wire. The left half 20 and the right half 30 can be conveniently connected together by: inserting the downward locating rod 24 into the rectangular slot 34 for permitting the hook 25 to be hooked in the retaining hole 35, and then hooking the horizontal locating ring 21 of the left half 20 on the half circularly arched upright wall 31 of the right half 30.

I claim:

1. A lamp socket comprising a socket body having a spiral groove for mounting a base of a conventional lamp bulb, a center metal contact plate and a side metal contact plate respectively fastened to said socket body for connection to a respective conductor of an electric wire, wherein said socket body comprises:

a right half portion, said right half portion comprising a base, which holds said center metal contact plate, a right half circularly arched upright wall raised from said base, a longitudinal locating groove on said right half circularly arched upright wall of said right half portion which receives said side metal contact plate, a rectangular slot on said base at an inner side, a retaining hole on said base at an outer side in communication with said rectangular slot, and a side metal contact slot disposed through said base which holds said side metal contact plate in said longitudinal locating groove; and a left half portion abutted to said right half portion, said left half portion comprising a horizontal locating ring hooked on outside of said right half circularly arched upright wall of said right half portion, a left half circularly arched upright wall extended downwardly from a bottom part of said horizontal locating ring and engaged on said base of said right half portion and abutted to said right half circularly arched upright wall of said right half portion, a downward locating rod extended downwardly from a bottom edge of said left half circularly arched upright wall inserted into said rectangular slot of said base of said right half protion, and a hook extended from said downward locating rod and hooked in said retaining hole of said base of said right half portion.

2. The lamp socket of claim 1 wherein said side metal contact plate comprises a longitudinal reinforcing rib formed by stamping for contact with said conventional lamp bulb's base.

3. The lamp socket of claim 1 wherein said side metal contact plate comprises a locating flange positioned in said side metal contact slot.

* * * * *